US011374334B2

(12) United States Patent
Watson

(10) Patent No.: US 11,374,334 B2
(45) Date of Patent: Jun. 28, 2022

(54) SELF-CANCELLING FULL DUPLEX ANTENNA ARRAY

(71) Applicant: Paul Robert Watson, Ottawa (CA)

(72) Inventor: Paul Robert Watson, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/921,492

(22) Filed: Jul. 6, 2020

(65) Prior Publication Data

US 2022/0006205 A1 Jan. 6, 2022

(51) Int. Cl.

| | |
|---|---|
| ***H01Q 21/24*** | (2006.01) |
| ***H01Q 15/14*** | (2006.01) |
| ***H01Q 9/04*** | (2006.01) |
| *H01Q 1/24* | (2006.01) |

(52) U.S. Cl.

CPC ..... *H01Q 21/24* (2013.01); *H01Q 9/0428* (2013.01); *H01Q 15/14* (2013.01); *H01Q 1/243* (2013.01); *H01Q 1/246* (2013.01)

(58) Field of Classification Search

CPC ..... H01Q 21/24; H01Q 1/243; H01Q 15/14
USPC ..... 343/835
See application file for complete search history.

(56) References Cited

U.S. PATENT DOCUMENTS

| | | | | |
|---|---|---|---|---|
| 10,779,265 | B2 * | 9/2020 | Kusashima | H04L 5/0053 |
| 2004/0108921 | A1 | 6/2004 | Sacco | |
| 2017/0141479 | A1 * | 5/2017 | Apostolos | H01Q 21/0068 |

FOREIGN PATENT DOCUMENTS

| | | | |
|---|---|---|---|
| CN | 2838058 | Y | 11/2006 |
| CN | 105529524 | A | 4/2016 |
| CN | 107039759 | A | 8/2017 |
| JP | 2003008341 | A | 1/2003 |

OTHER PUBLICATIONS

N. M. Gowda and A. Sabharwal, "JointNull: Combining Partial Analog Cancellation With Transmit Beamforming for Large-Antenna Full-Duplex Wireless Systems," in IEEE Transactions on Wireless Communications, vol. 17, No. 3 Mar. 2018.

Yang Ning-fang et al, Assembling Technology for Radiating Elements and Complete Parallel Plate Waveguide Microstrip Antenna Array, Electro-Mechanical Engineering, 2006, vol. 22, No. 5, with an English Abstract, total 4 pages.

H. Miyashita et al, Capacitor antenna in a parallel plate waveguide, IEEE Antennas and Propagation Society International Symposium. Digest. Held in conjunction with: USNC/CNC/URSI North American Radio Sci. Meeting (Cat. No. 03CH37450), Date of Conference: Jun. 22-27, 2003, Date Added to IEEE Xplore: Aug. 18, 2003, total 4 pages.

* cited by examiner

*Primary Examiner* — Peguy Jean Pierre

(57) ABSTRACT

An antenna array for full duplex communications is described. The antenna array includes an array antenna elements supported by a substrate. The substrate includes a feed network and a parallel plate waveguide layered with the feed network. The parallel plate waveguide has a core of varying dielectric constant, wherein the varying dielectric constant varies from a first probe connected to a first antenna element to a second probe connected to a second antenna element.

17 Claims, 7 Drawing Sheets

SELF-CANCELLING FULL DUPLEX ANTENNA ARRAY

FIELD

The present disclosure relates to antenna arrays, in particular antenna arrays for full duplex communications.

BACKGROUND

Full duplex radio technology has been of interest for wireless communications, including for use in fifth-generation (5G) wireless networks, with transmission and reception of radio signals using a common antenna and transceiver. In full duplex communications, transmission signals and reception signals are communicated using the same time-frequency resource (e.g., using the same carrier frequency at the same time). Full duplex communication offers the possibility of double the communication capacity on a given bandwidth.

Adaptive beamforming is a technique that can be used to optimize the propagation path between a base station (BS) antenna array and a recipient electronic device (ED), such as a user equipment (UE). Generally, larger antenna arrays (which are larger in terms of having a greater number of antenna elements) are required to achieve beam steering as well as high gain. These larger antenna arrays typically have relatively small separation between adjacent antenna elements. For example, the separation between adjacent antenna elements may be approximately $\lambda/2$ (where $\lambda$ is the operating wavelength). Such close proximity of antenna elements may result in significant mutual coupling between antenna elements, and particularly between adjacent antenna elements. This mutual coupling couples the transmit element signal to the receive element signal, which interferes with the full duplex operation of the antenna array, and is therefore undesirable.

Conventional topologies that have been designed to cancel these mutual couplings and increase port-to-port isolations typically become overwhelmingly cumbersome as the number of coupled paths multiply to very large numbers in larger antenna arrays. Accordingly, it would be desirable to provide an antenna array that provides at least some self-cancellation of such mutual couplings.

SUMMARY

In various examples, the present disclosure describes a topology for an antenna array that helps to increase port-to-port antenna isolations. The disclosed configuration may be used in a large and/or dense antenna array. A parallel two dimensional (2D) self-cancellation network is integrated into the antenna array, which helps to reduce mutual coupling between antenna elements.

In some example aspects, the present disclosure describes an antenna array for full duplex communications. The antenna array includes: an array of at least two antenna elements; and a substrate supporting the array of antenna elements. The substrate includes: a feed network including a plurality of probes, each probe being connected to a respective antenna element; and a parallel plate waveguide layered with the feed network, the parallel plate waveguide having a core of varying dielectric constant, wherein the varying dielectric constant varies from a first probe connected to a first antenna element to a second probe connected to a second antenna element.

In any of the examples, the core may have a varying dielectric constant to cause a parallel plate wave that propagates from the first antenna element to the second antenna element to have a phase offset with a surface wave that propagates from the first antenna element to the second antenna element, to cause cancellation of the parallel plate wave with the surface wave at the second probe.

In any of the examples, the core may include two or more materials having different dielectric constants.

In any of the examples, the core may include a core material having voids.

In any of the examples, the voids may have dimensions that vary along a gradation between the first probe and the second probe.

In any of the examples, the voids may increase in size with increasing distance from each probe, and decrease in size with decreasing distance from each probe.

In any of the examples, the voids may be arranged in a symmetrical arrangement about each probe.

In any of the examples, the core may have a varying dielectric constant that increases towards each probe and decreases towards a midpoint between adjacent probes.

In any of the examples, the substrate may further include a reflector layered with the feed network.

In any of the examples, the antenna elements may be circularly polarized antenna elements.

In some aspects, the present disclosure describes an apparatus that includes an antenna array. The antenna array includes an array of at least two antenna elements; and a substrate supporting the array of antenna elements. The substrate includes: a feed network including a plurality of probes, each probe being connected to a respective antenna element; and a parallel plate waveguide layered with the feed network, the parallel plate waveguide having a core of varying dielectric constant, wherein the varying dielectric constant varies from a first probe connected to a first antenna element to a second probe connected to a second antenna element. The apparatus also includes: a transmitter coupled to the antenna array for providing a transmit signal; and a receiver coupled to the antenna array for receiving a receive signal.

In any of the examples, in the antenna array, the core may have varying dielectric constant to cause a parallel plate wave that propagates from the first antenna element to the second antenna element to have a phase offset with a surface wave that propagates from the first antenna element to the second antenna element, to cause cancellation of the parallel plate wave with the surface wave at the second probe.

In any of the examples, in the antenna array, the core may include two or more materials having different dielectric constants.

In any of the examples, in the antenna array, the core may include a core material having voids.

In any of the examples, in the antenna array, the voids may have dimensions that vary along a gradation between the first probe and the second probe.

In any of the examples, in the antenna array, the core may have a varying dielectric constant that increases towards each probe and decreases towards a midpoint between adjacent probes.

In any of the examples, the apparatus may be configured to conduct full-duplex communications.

In any of the examples, the apparatus may be a base station.

In any of the examples, the apparatus may be a user equipment (UE).

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
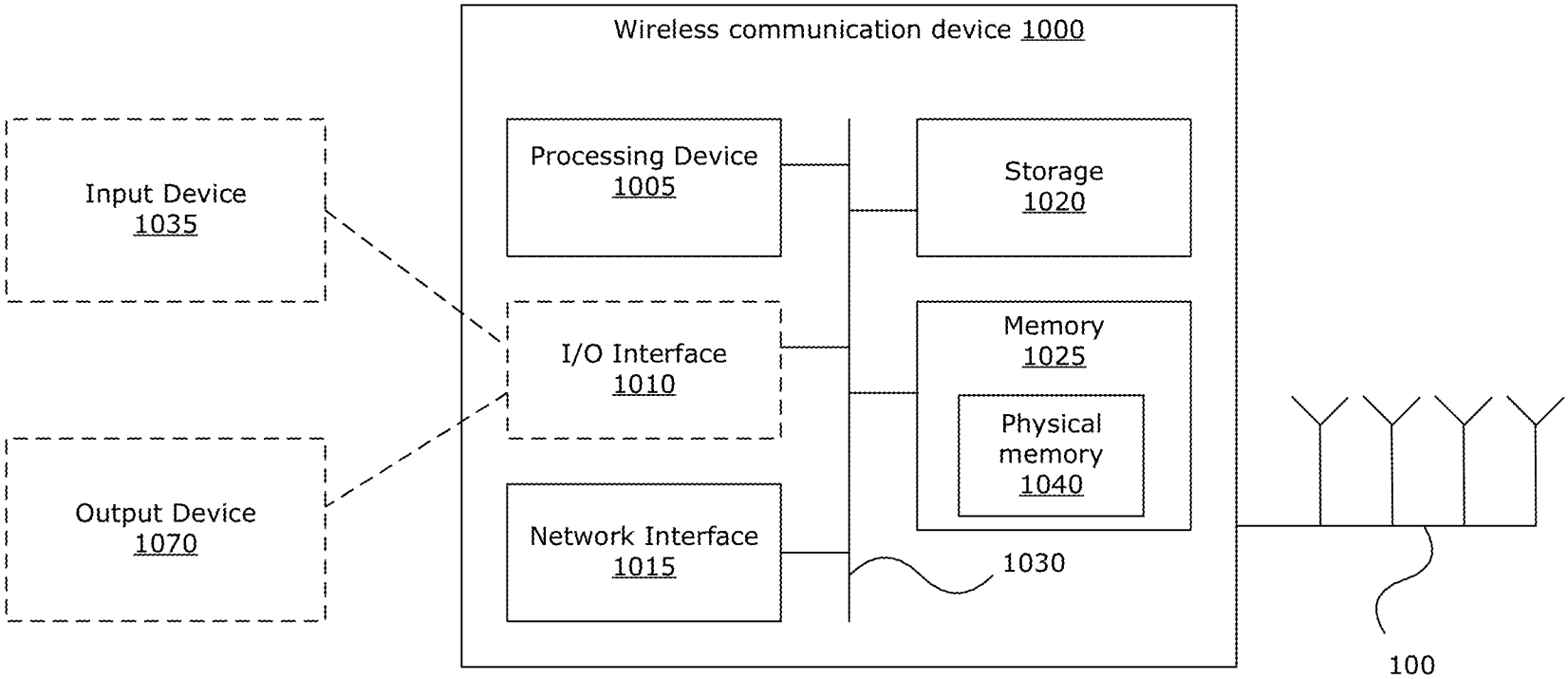
FIG. 1 is a schematic diagram of an example wireless communication device, in which an example of the disclosed antenna array may be implemented.

FIG. 1 is a schematic diagram of an example wireless communication device 1000, in which examples of the antenna array 100 described herein may be used. For example, the wireless communication device 1000 may be a base station (BS), an access point (AP), or a client terminal (also referred to as a user equipment (UE) or electronic device (ED)) in a wireless communication network. The wireless communication device 1000 may be used for communications within 5G communication networks or other wireless communication networks. Although FIG. 1 shows a single instance of each component, there may be multiple instances of each component in the wireless communication device 1000. The wireless communication device 1000 may be implemented using parallel and/or distributed architecture.

The wireless communication device 1000 may include one or more processing devices 1005, such as a processor, a microprocessor, an application-specific integrated circuit (ASIC), a field-programmable gate array (FPGA), a dedicated logic circuitry, or combinations thereof. The wireless communication device 1000 may also include one or more optional input/output (I/O) interfaces 1010, which may enable interfacing with one or more optional input devices 1035 and/or output devices 1070. The wireless communication device 1000 may include one or more network interfaces 1015 for wired or wireless communication with a network (e.g., an intranet, the Internet, a P2P network, a WAN and/or a LAN, and/or a Radio Access Network (RAN)) or other node. The network interface(s) 1015 may include one or more interfaces to wired networks and wireless networks. Wired networks may make use of wired links (e.g., Ethernet cable). The network interface(s) 1015 may provide wireless communication (e.g., full-duplex communications) via an example of the disclosed antenna array 100. The wireless communication device 1000 may also include one or more storage units 1020, which may include a mass storage unit such as a solid state drive, a hard disk drive, a magnetic disk drive and/or an optical disk drive.

The wireless communication device 1000 may include one or more memories 1025 that can include a physical memory 1040, which may include a volatile or non-volatile memory (e.g., a flash memory, a random access memory (RAM), and/or a read-only memory (ROM)). The non-transitory memory(ies) 1025 (as well as storage 1020) may store instructions for execution by the processing device(s) 1005. The memory(ies) 1025 may include other software instructions, such as for implementing an operating system (OS), and other applications/functions. In some examples, one or more data sets and/or modules may be provided by an external memory (e.g., an external drive in wired or wireless communication with the wireless communication device 1000) or may be provided by a transitory or non-transitory computer-readable medium. Examples of non-transitory computer readable media include a RAM, a ROM, an erasable programmable ROM (EPROM), an electrically erasable programmable ROM (EEPROM), a flash memory, a CD-ROM, or other portable memory storage.

There may be a bus 1030 providing communication among components of the wireless communication device 1000. The bus 1030 may be any suitable bus architecture including, for example, a memory bus, a peripheral bus or a video bus. Optional input device(s) 1035 (e.g., a keyboard, a mouse, a microphone, a touchscreen, and/or a keypad) and optional output device(s) 1070 (e.g., a display, a speaker and/or a printer) are shown as external to the wireless communication device 1000, and connected to optional I/O interface 1010. In other examples, one or more of the input device(s) 1035 and/or the output device(s) 1070 may be included as a component of the wireless communication device 1000. The processing device(s) 1005 may be used to control communicate transmission/reception signals to/from the antenna array 100. The processing device(s) 1005 may also be used to control beamforming and beam steering by the antenna array 100.

Figure 2:
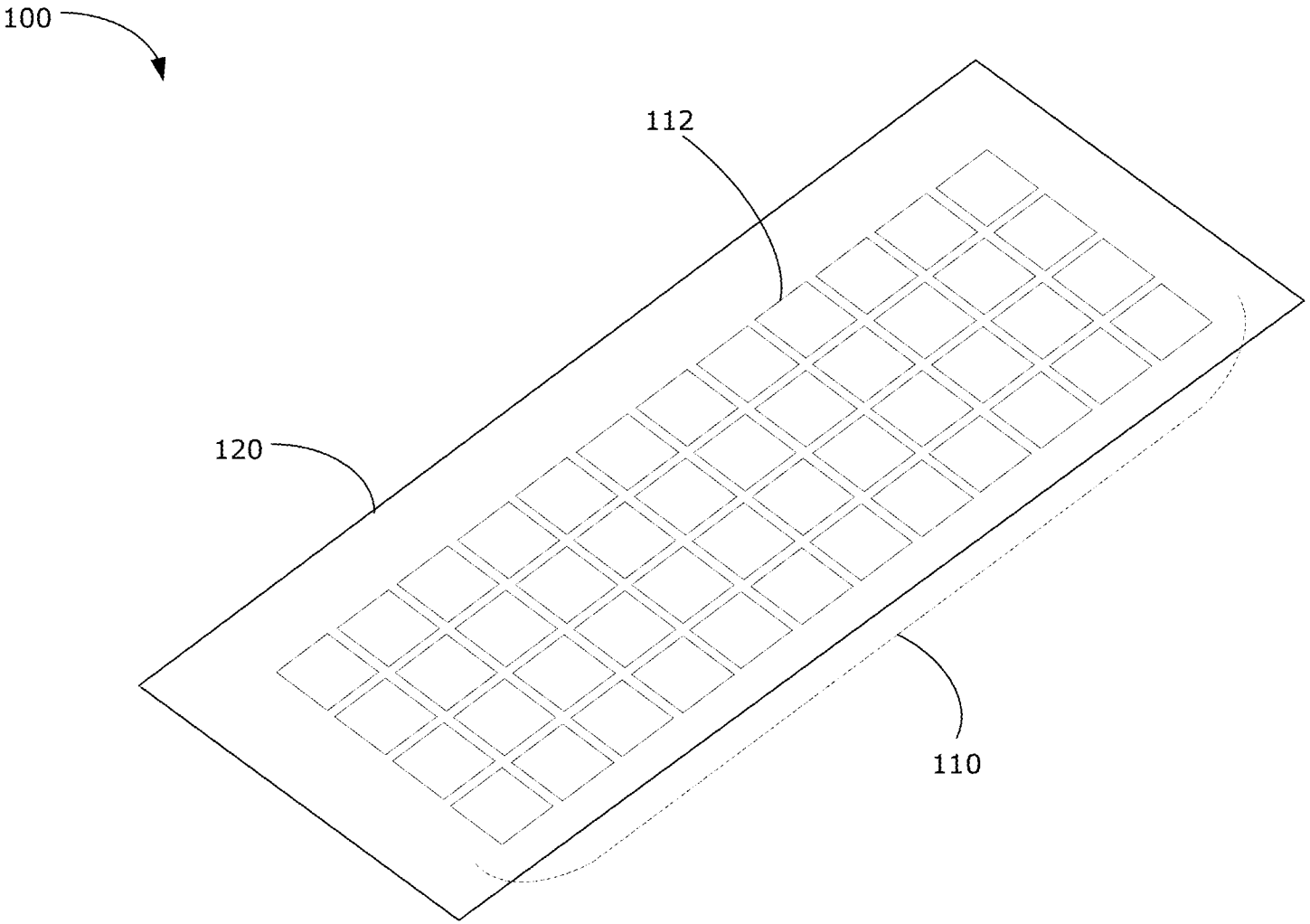
FIG. 2 is schematic diagram of an isometric view of an example antenna array.

FIG. 2 shows a perspective view of an example antenna array 100 as disclosed herein. The antenna array 100 (which may also be referred to as an array antenna, an array of antennas, or simply as an antenna) includes an array 110 of a plurality of antenna elements 112 (which may also be referred to as radiating elements), which may be supported by a substrate 120. In the example shown, the array 110 includes a plurality of linear columns of antenna elements 112. The antenna array 100 may be described as an M×N array, in which the antenna elements 112 are arranged in an array 110 having M rows and N columns.

Figure 3:
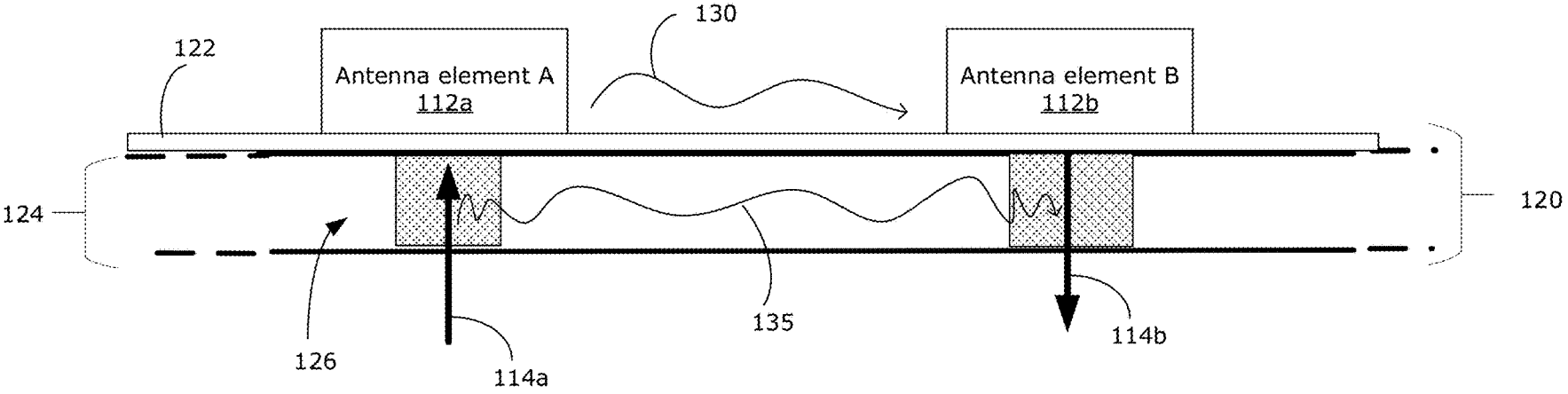
FIG. 3 is a cutaway view of a portion of the example antenna array of FIG. 2, illustrating an example of surface wave and parallel plate waveguide couplings between two antenna elements.

FIG. 3 is a cutaway view of a portion of an example of the antenna array 100 described herein. It should be noted that FIG. 3 is not shown to scale, and some dimensions have been exaggerated or diminished for clarity. FIG. 3 illustrates port-to-port couplings between antenna element A 112*a* and antenna element B 112*b* in the same antenna array 100. Antenna elements A and B 112*a*, 112*b* are supported by a substrate 120 that enables parallel plate waveguide propagation. For example, the substrate 120 includes an antenna reflector 122 and a parallel plate waveguide 124. The antenna reflector 122 and the parallel plate waveguide 124 extend over the entire antenna array 100. The parallel plate waveguide 124 has a core 126 of varying dielectric constant (indicated by differently-shaded blocks). For example, the core 126 may have varying density (e.g., being formed of materials having different density, or having voids or air gaps) to give rise to the varying dielectric constant.

In the example shown, antenna element A 112*a* is excited by an input signal at a probe 114*a* (also referred to as an antenna feed), and is caused to radiate a radiofrequency (RF) signal (not shown). Waves radiated by antenna element A 112*a* can propagate to antenna element B 112*b* and cause port-to-port couplings that can be picked up at a probe 114*b* feeding antenna element B 112*b*.

There is a surface wave 130 that propagates on the surface of the substrate 120 (in this case, along the surface of the reflector 122). There is also a parallel plate wave 135 that propagates via the parallel plate waveguide 124. The propagation of both waves 130, 135 are predominantly in a 2D plane parallel to the plane of the substrate 120. The propagation of the waves 130, 135 effectively are separate and take place via separate port-to-port coupling networks.

The magnitude of the port-to-port coupling between antenna elements via the surface wave 130 typically is not controlled beyond selecting an appropriate antenna topology. On the other hand, the port-to-port coupling via the parallel plate wave 135 within the parallel plate waveguide 124 is controllable by design of the probes 114*a*, 114*b* and/or by design of the parallel plate waveguide 124. In this example, the probes 114*a*, 114*b* are designed for controlling magnitude of the propagated wave 135. The parallel plate waveguide 124 has a core 126 of varying dielectric constant, which is designed for controlling the phase of the propagated wave 135. In particular, the core 126 is designed to achieve a phase shift such that the parallel plate wave 135 reaching the probe 114*b* at antenna element B 112*b* cancels out (or at least reduces) the surface wave 130 reaching the probe 114*b* at antenna element B 112*b* over the antenna reflector 122.

Consider an excitation signal $Ae^{j0}$ that is fed to antenna element A 112*a* via the probe 114*a*. The magnitude A may be controlled by the feed network, in particular by the radius of the probe 114*a*. This causes excitation at antenna element A 112*a* and RF power to be transmitted out. The signal is also coupled to the probe 114*b* at antenna element B 112*b* via the surface wave 130 along the surface of the reflector 122. This surface port-to-port coupling arrives at antenna element B as a first coupling signal $BA'e^{j\theta}$, where B is the magnitude controlled by the radius of the probe 114*b* at antenna element B 112*b*, and A' is the diminished magnitude of the surface wave 130. A phase delay θ is introduced due to the propagation along the surface of the reflector 122. At the same time as the propagation of the surface wave 130, the signal is also coupled to the probe 114*b* at antenna element B 112*b* via propagation of the parallel plate wave 135 along the parallel plate waveguide 124.

The core 126 of the parallel plate waveguide 124, in this example, has sections of higher dielectric constant (shaded) and sections of lower dielectric constant (unshaded), resulting in varying wave velocity (slower in sections of higher dielectric constant and faster in sections of lower dielectric constant) as the parallel plate wave 135 propagates. The varying dielectric constant in the core 126 causes a further phase delay such that the parallel plate port-to-port coupling arrives at the probe 114*b* as a second coupling signal $BA'e^{j(\theta+\pi)}$ that has substantially the same magnitude as the first coupling signal but is 180° out-of-phase with the first coupling signal. The result is that the first coupling signal and the second coupling signal cancel out each other, and the port-to-port coupling at the probe 114*b* of antenna element B 112*b* is substantially equal to zero.

The probes 114*a*, 114*b* are designed to control the magnitude (power) of the coupling signals, to achieve the desired self-cancellation and also to allow the remaining power of the desired input signal to pass on to excite the antenna element 112*a*.

It should be noted that any suitable design for the parallel plate waveguide 124 may be used to cause the second coupling signal to be 180° out-of-phase with the first coupling signal when both arrive at the probe 114*b* at antenna element B 112*b*. In particular, any technique for varying the dielectric constant in the core 126 may be used to achieve the desired cancellation of coupling signals.

FIG. 3 illustrates cancellation of port-to-port coupling in one direction of propagation for simplicity. It should be understood that the 2-dimensional, radial propagation of the surface wave 130, in any direction, is mirrored by propagation of the parallel plate wave 135. The parallel plate waveguide 124 is designed with a core 126 that has appropriately varying dielectric constant in all directions of propagation, such that cancellation (or at least reduction) of port-to-port coupling is achieved in all directions of propagation, at least between immediate neighboring (or adjacent) antenna elements. The port-to-port mutual coupling may also be cancelled or at least reduced between antenna elements that are further apart (not immediately adjacent to each other).

Figure 4:
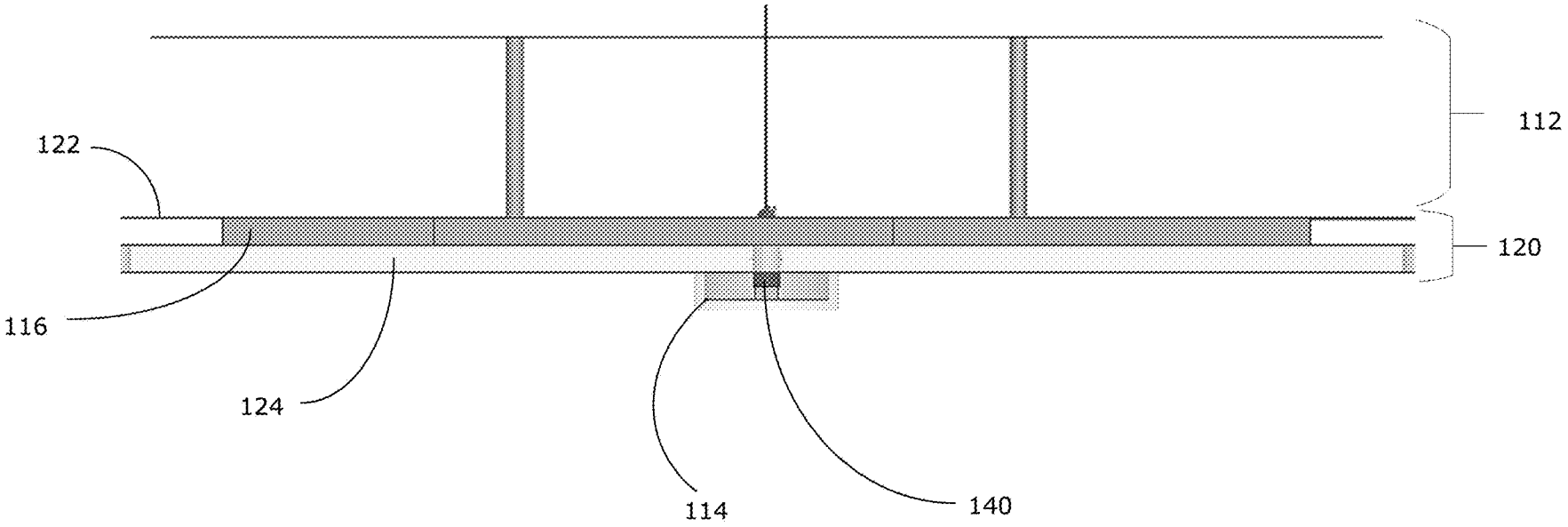
FIG. 4 is a detailed cutaway view of an example antenna element and substrate in the antenna array of FIG. 2.

FIG. 4 is a more detailed cutaway view focusing on one antenna element. FIG. 4 is more similar to an actual implementation of the examples described herein; however, it should be understood that FIG. 4 is not necessarily shown to-scale, and the dimensions represented in FIG. 4 are not intended to be limiting. In FIG. 4, the antenna element 112 is supported by the substrate 120 that include the reflector 122 and the parallel plate waveguide 124 (the core of which is not shown here in detail for simplicity). The substrate 120 also includes a feed network 116 that is tapped by the antenna probe (not shown). An antenna input port 140 feeds excitation signals to the feed network 116 via the probe 114. It should be noted that the parallel plate waveguide 124 is layered (or stacked) with and substantially on a parallel plane with the feed network 116. The parallel plate waveguide 124 may be considered to be a self-cancellation network that is layered with the feed network 116, to provide a layered substrate 120.

As noted above, the parallel plate waveguide having a core with varying dielectric constant may be implemented in various ways. An example is a parallel plate waveguide with a core made of materials of varying density. Another example is a parallel plate waveguide with a core in which varying dielectric constant is achieved through the use of voids or air gaps.

Figure 5:
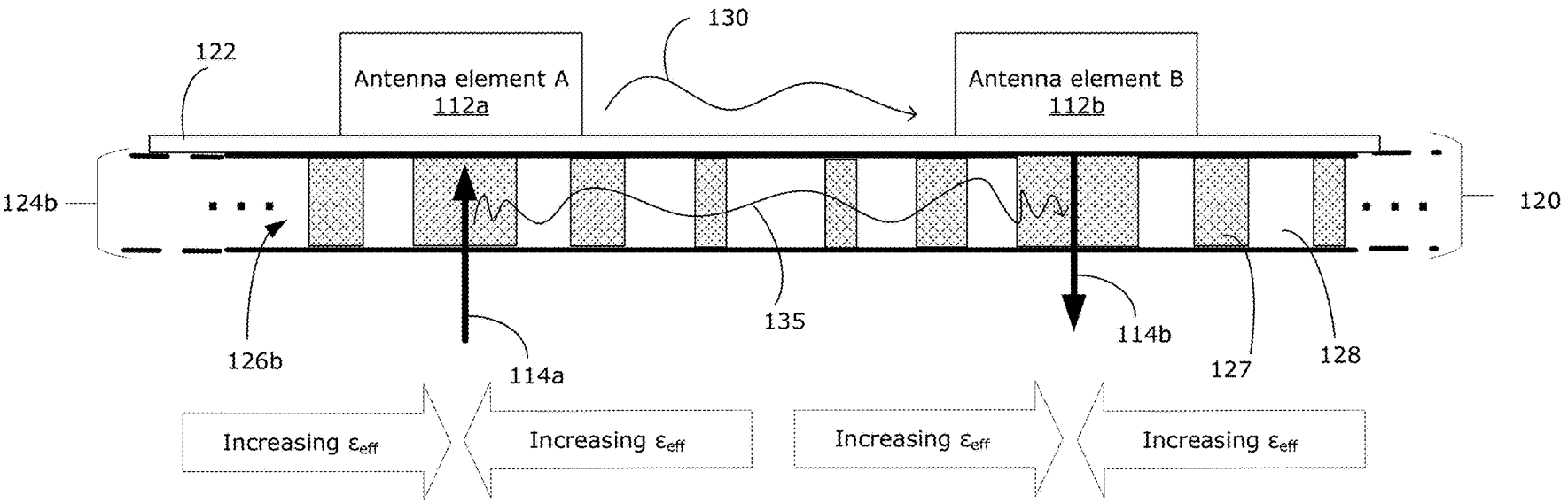
FIG. 5 is a cutaway view of a portion of another embodiment of the example antenna array of FIG. 2.

FIG. 5 is a cutaway view of a portion of another example of the antenna array described herein. FIG. 5 is similar to FIG. 3, and elements that are common to both will not be described again in detail here. It should be noted that FIG. 5 is not shown to scale, and some dimensions have been exaggerated or diminished for clarity.

Compared to FIG. 3, the parallel plate waveguide 124*b* in FIG. 5 has a core 126*b* that includes a core material 127 (e.g., any suitable dielectric material) and voids 128. The voids 128 may be introduced into the core 126*b* by etching out or drilling out portions of the core material 127, or may be introduced as controlled bubbles in the core material 127 when the parallel plate waveguide 124*b* is manufactured, for example.

The presence of the voids 128 result in an effective dielectric constant that is different than the dielectric constant of the core material 127 by itself. The voids 128 are controlled in size, density and distribution such that the effective dielectric constant in the core 126*b* is varying. In particular, the voids 128 are interspersed in the core material 127 such that there is a gradation in the effective dielectric constant. In the example shown in FIG. 5, the voids 128 vary in size, increasing in size with increasing distance from the probe 114*a* at antenna element A 112*a* and decreasing in size again with decreasing distance from the probe 114*b* at antenna element B 112*b*. It should be noted that in this example that the voids 128 are designed to be symmetrical about each probe 114*a*, 114*b*. The effective dielectric constant $\varepsilon_{eff}$ that is achieved with this design has a gradation that increases with decreasing distance to each probe 114*a*, 114*b*, as indicated by arrows in FIG. 5.

The resulting parallel plate waveguide 124*b* causes a 180° phase offset between the surface wave 130 and the parallel plate wave 135 when both arrive at the probe 114*b* at antenna element B 112*b*, thus cancelling the port-to-port mutual coupling, similar to that described above with respect to FIG. 3. It should be understood that, in other examples, the effective dielectric constant $\varepsilon_{eff}$ may vary in other ways (e.g., increasing with increasing distance from each probe 114*a*, 114*b*, or monotonically increasing/decreasing from one probe 114*a* to the adjacent probe 114*b*), provided that the desired 180° phase offset between the surface wave 130 and the parallel plate wave 135 is achieved.

Figure 6:
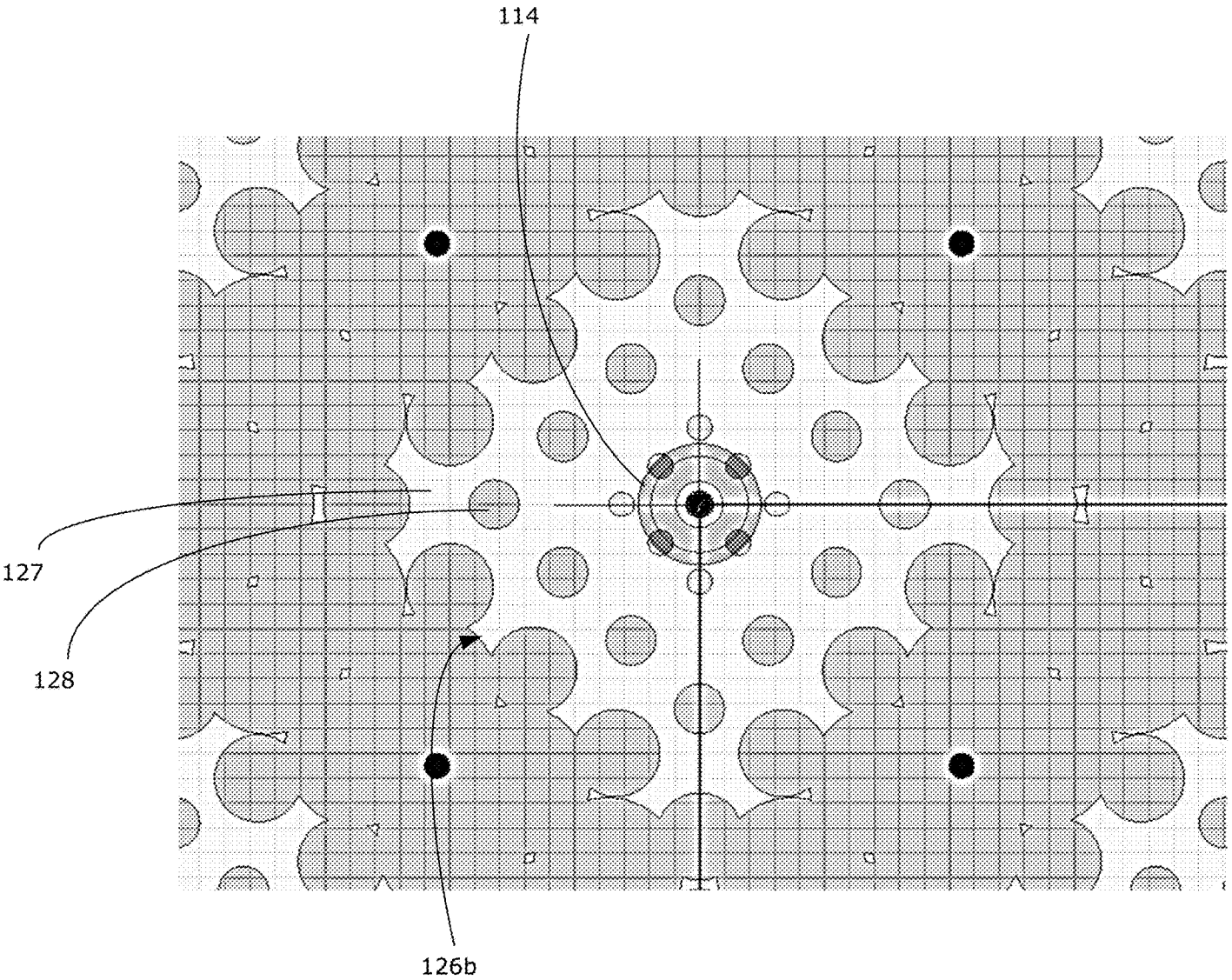
FIG. 6 is a top-down view of an example antenna element and substrate, implementing the design of FIG. 5.
Figure 7:
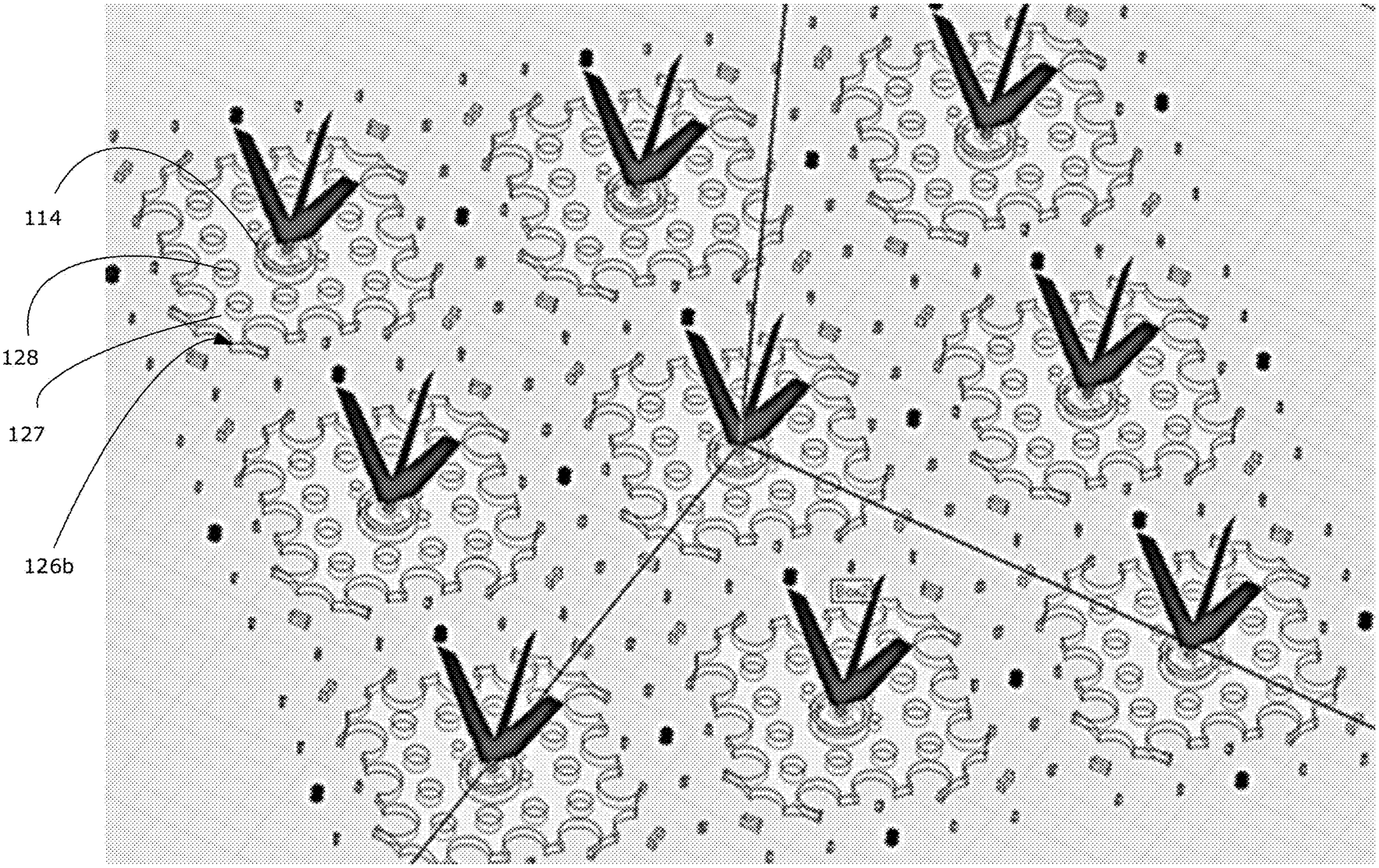
FIG. 7 is an isometric view of an example antenna array comprising the antenna element and substrate of FIG. 6.

FIG. 6 is a top-down view of an example implementation of the design described with respect to FIG. 5. FIG. 7 is an isometric view of an example antenna array 100 comprising the antenna element of FIG. 6. In FIGS. 6 and 7, the antenna elements and reflector are not shown, to enable the core 126*b* of the parallel plate waveguide to be viewed. As can be appreciated from FIGS. 6 and 7, the voids 128 are introduced in the core material 127 in a symmetrical pattern about the probe 114, and the voids 128 increase in size and density with increasing distance from the probe 114 (and decrease in size and density with decreasing distance to the adjacent probe 114). The result is that the voids 128 are largest towards the midpoint between adjacent probe 114.

The present disclosure has described examples in which the antenna array substrate includes a parallel plate waveguide having a core with varying dielectric constant, in order to introduce a phase offset (e.g., 180° phase offset) between a surface wave and a parallel plate wave that both propagate from a radiating antenna element. In some examples, the varying dielectric constant may be achieved using materials of different density in the core of the parallel plate waveguide. In other examples, the varying dielectric constant may be achieved by introducing voids in the dielectric material in the core of the parallel plate waveguide. Generally, any approach may be used to achieve a varying dielectric constant in the parallel plate waveguide, to result in the desired phase offset.

The present disclosure describes example designs for an antenna that help provide cancellation of unwanted mutual coupling between ports of antenna elements in a dense antenna array. The design described herein (which may be referred to as a self-cancellation network) may be integrated into the conventional feed path of the antenna array, for example by layering the parallel plate waveguide with the feed network, in a layered substrate construction, as shown in FIG. 4. Such an approach may facilitate integration of the disclosed design in various different applications.

The antenna feed network may be independently incorporated on a layer in parallel with the self-cancellation network. The antenna feed network may be designed for any suitable feeding of the antenna elements (e.g., for 0°, 90°, 180° and/or 270° feeding of circularly polarized antenna elements). In examples described herein, the antenna array includes circularly polarized antenna elements. In other examples, other types of antenna elements may be used.

The examples described herein may provide an alternative to conventional designs that rely on couplers and cablings to cancel unwanted coupling pairs of ports in a large array. Compared to conventional designs, the examples described herein may be less expensive, more reliable and/or easier to integrate into the physical antenna.

Examples of the disclosed antenna may be suitable for used in a full-duplex antenna array (e.g., for full duplex communications in 5G networks, and for multiple-input multiple-output (MIMO) applications), including a closely-packed array configuration, for example for use in a base station or access point of a wireless communication network. The present disclosure encompasses such apparatuses that include the disclosed antenna array. Examples of the disclosed antenna may also be used in other wireless communication devices, including client devices such as a laptop device. Various examples of the disclosed antenna array may be suitable for use in broadband, full-duplex communications.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure. For examples, although certain sizes and shapes of the disclosed antenna have been shown, other sizes and shapes may be used.

All values and sub-ranges within disclosed ranges are also disclosed. Also, while the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. The subject matter described herein intends to cover and embrace all suitable changes in technology.

The invention claimed is:

1. An antenna array for full duplex communications, the antenna array comprising:

an array of at least two antenna elements; and a substrate supporting the array of antenna elements, the substrate including:

a feed network including a plurality of probes, each probe being connected to a respective antenna element; and a parallel plate waveguide layered with the feed network, the parallel plate waveguide having a core of varying dielectric constant, wherein the varying dielectric constant varies from a first probe connected to a first antenna element to a second probe connected to a second antenna element, and wherein the core of varying dielectric constant causes a parallel plate wave that propagates from the first antenna element to the second antenna element to have a phase offset with a surface wave that propagates from the first antenna element to the second antenna element, to cause cancellation of the parallel plate wave with the surface wave at the second probe.

2. The antenna array of claim 1, wherein the core comprises two or more materials having different dielectric constants.

3. The antenna array of claim 1, wherein the core comprises a core material having voids.

4. The antenna array of claim 3, wherein the voids have dimensions that vary along a gradation between the first probe and the second probe.

5. The antenna array of claim 3, wherein the voids increase in size with increasing distance from each probe, and decrease in size with decreasing distance from each probe.

6. The antenna array of claim 3, wherein the voids are arranged in a symmetrical arrangement about each probe.

7. The antenna array of claim 1, wherein the varying dielectric constant of the core increases towards each probe and decreases towards a midpoint between adjacent probes.

8. The antenna array of claim 1, wherein the substrate further comprises a reflector layered with the feed network.

9. The antenna array of claim 1, wherein the antenna elements are circularly polarized antenna elements.

10. An apparatus comprising:

an antenna array comprising:

an array of at least two antenna elements; and a substrate supporting the array of antenna elements, the substrate including:

a feed network including a plurality of probes, each probe being connected to a respective antenna element; and a parallel plate waveguide layered with the feed network, the parallel plate waveguide having a core of varying dielectric constant, wherein the varying dielectric constant varies from a first probe connected to a first antenna element to a second probe connected to a second antenna element, and wherein the core of varying dielectric constant causes a parallel plate wave that propagates from the first antenna element to the second antenna element to have a phase offset with a surface wave that propagates from the first antenna element to the second antenna element, to cause cancellation of the parallel plate wave with the surface wave at the second probe, a transmitter coupled to the antenna array for providing a transmit signal; and a receiver coupled to the antenna array for receiving a receive signal.

11. The apparatus of claim 10, wherein, in the antenna array, the core comprises two or more materials having different dielectric constants.

12. The apparatus of claim 10, wherein, in the antenna array, the core comprises a core material having voids.

13. The apparatus of claim 12, wherein, in the antenna array, the voids have dimensions that vary along a gradation between the first probe and the second probe.

14. The apparatus of claim 10, wherein, in the antenna array, the varying dielectric constant of the core increases towards each probe and decreases towards a midpoint between adjacent probes.

15. The apparatus of claim 10, wherein the apparatus is configured to conduct full-duplex communications.

16. The apparatus of claim 10, wherein the apparatus is a base station.

17. The apparatus of claim 10, wherein the apparatus is a user equipment (UE).

* * * * *